United States Patent [19]

Stockwell et al.

[11] Patent Number: 4,905,957

[45] Date of Patent: Mar. 6, 1990

[54] ICE MOLD APPARATUS

[76] Inventors: Aubrey E. Stockwell; Donald A. Stockwell, both of 3448 Main St., St. Clair, Mich. 48079

[21] Appl. No.: 286,636

[22] Filed: Dec. 19, 1988

[51] Int. Cl.[4] ..... B22C 9/08; B41B 11/54

[52] U.S. Cl. ..... 249/108; 249/160; 249/165; 249/167; 425/DIG. 47

[58] Field of Search ..... 249/55, 105, 108, 121, 249/164, 165, 205, 160, 167; 425/DIG. 47, 578, 499, 585, 583; 220/85 F, 85 SP, 86 R, 229; 141/336, 365, 371, 369

[56] References Cited

U.S. PATENT DOCUMENTS

| | | | |
|---|---|---|---|
| D. 162,798 | 4/1951 | Ebbott | D15/90 |
| D. 263,398 | 3/1982 | Tiller | D15/90 |
| 1,817,339 | 8/1931 | Barnes | 249/55 |
| 1,923,522 | 8/1933 | Whitehouse | 62/530 |
| 2,558,620 | 6/1951 | Lisota | 220/86 R |
| 2,756,567 | 7/1956 | Martin | 249/70 |
| 3,309,738 | 3/1967 | Friedman | 249/164 |
| 3,354,508 | 11/1967 | Draben | 425/449 |
| 3,881,682 | 5/1975 | Kim | 249/164 |
| 3,966,166 | 6/1976 | Elliott | 249/55 |
| 4,427,110 | 1/1984 | Shaw, Jr. | 220/229 |
| 4,432,529 | 1/1984 | McMillan | 249/121 |
| 4,784,366 | 11/1988 | Muller | 249/108 |
| 4,817,911 | 4/1989 | Infanti | 249/55 |

FOREIGN PATENT DOCUMENTS

| | | | |
|---|---|---|---|
| 61-74810 | 4/1986 | Japan | 425/DIG. 47 |
| 61-121917 | 9/1986 | Japan | 425/DIG. 47 |

*Primary Examiner*—Jay H. Woo
*Assistant Examiner*—K. P. Nguyen
*Attorney, Agent, or Firm*—Leon Gilden

[57] ABSTRACT

An ice mold apparatus is set forth wherein a plurality of separable halves including a plurality of securement straps with ends secured to the lower mold half formed with resilient sections to enable expansion of the mold and prevent damage thereto during ice expansion. An overlying funnel is provided with a flange positioned within a housing on the top surface of the upper mold including a self-sealing iris diaphragm wherein the funnel may be directed through the diaphragm to enable complete filling of the mold. The mold interfacing edges are provided with a continuous seal formed within a semi-circular channel in the lower mold and further provided with a series of alignment pins registrable with openings in the upper mold for precise alignment and sealing of the mold halves.

1 Claim, 4 Drawing Sheets

ICE MOLD APPARATUS

BACKGROUND OF THE INVENTION

1. Field of the Invention

The field of invention relates to an ice mold apparatus, and more particularly pertains to a new and improved ice mold apparatus wherein the same provides for enhanced sealing and filling means associated with the mold apparatus.

2. Description of the Prior Art

The use of molds for providing desired configurations during freezing of contained fluid therewithin are known in the prior art. Ice molds of the prior art have generally failed to provide encompassing molds as set forth by the instant invention and wherein further the molds of the prior art have failed to provide appropriate filling means for use with such an encompassing mold apparatus. For example, U.S. Pat. No. D. 162,798 to Ebbott and U.S. Pat. No. D. 263,398 to Tiller are typical of ornamental molds illustrating bottom half type molds that preclude the use of an encompassing mold, as set forth by the instant invention to prevent contamination of the fluid contained within the mold during a freezing procedure.

U.S. Pat. No. 1,817,739 to Barnes sets forth a further mold provided with an overlying lid to secure the mold articles therewithin, but the mold of Barnes fails to provide the use of plural mold halves to provide a sealing arrangement, as does the instant invention.

U.S. Pat. No. 1,925,522 to Whitehouse sets forth a mold for use in a refrigerator wherein an overlying half is utilized, but fails to provide a filling means such as the funnel utilized by the instant invention to provide complete filling of the mold in use.

U.S. Pat. No. 2,756,567 to Martin sets forth a typical mold tray utilized with configured bottom molds for providing desired configuration of a frozen fluid with supports between the mold and an underlying tray surface to provide rigidity to the mold structure.

As such, it may be appreciated that there continues to be a need for a new and improved ice mold apparatus which addresses both the problems of compactness of construction and effectiveness in use, and in this respect, the present invention substantially fulfills this need.

SUMMARY OF THE INVENTION

In view of the foregoing disadvantages inherent in the known types of ice mold apparatus now present in the prior art, the present invention provides an ice mold apparatus wherein the same provides for a compact organization allowing for expansion of the ice mold preventing damage thereto during freezing of contained fluid therewith. As such, the general purpose of the present invention, which will be described subsequently in greater detail, is to provide a new and improved ice mold apparatus which has all the advantages of the prior art ice mold apparatus and none of the disadvantages.

To attain this, the present invention comprises an ice mold apparatus with a plurality of mold halves positionable together in a sealing arrangement including an interface continuous seal formed with upwardly projecting pins registrable within openings within the complementary ice mold interface surface and further including flexible overlying adjustable straps to enable expansion of the plural ice mold halves during freezing of a contained fluid. A funnel is selectively projectable through an iris diaphragm that seals upon withdrawal of the funnel stem therefrom to ensure sealing of the ice mold limiting contamination of contained fluid therewithin.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved ice mold apparatus which has all the advantages of the prior art ice mold apparatus and none of the disadvantages.

It is another object of the present invention to provide a new and improved ice mold apparatus which may be easily and efficiently manufactured and marketed.

It is a further object of the present invention to provide a new and improved ice mold apparatus which is of a durable and reliable construction.

An even further object of the present invention is to provide a new and improved ice mold apparatus which is susceptible of a low cost of manufacture with regard to both materials and labor, and which accordingly is then susceptible of low prices of sale to the consuming public, thereby making such ice mold apparatus economically available to the buying public.

Still yet another object of the present invention is to provide a new and improved ice mold apparatus which provides in the apparatuses and methods of the prior art some of the advantages thereof, while simultaneously overcoming some of the disadvantages normally associated therewith.

Still another object of the present invention is to provide a new and improved ice mold apparatus wherein the same provides for an encompassing mold allowing for expansion of fluid contained therewith during freezing of the fluid.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
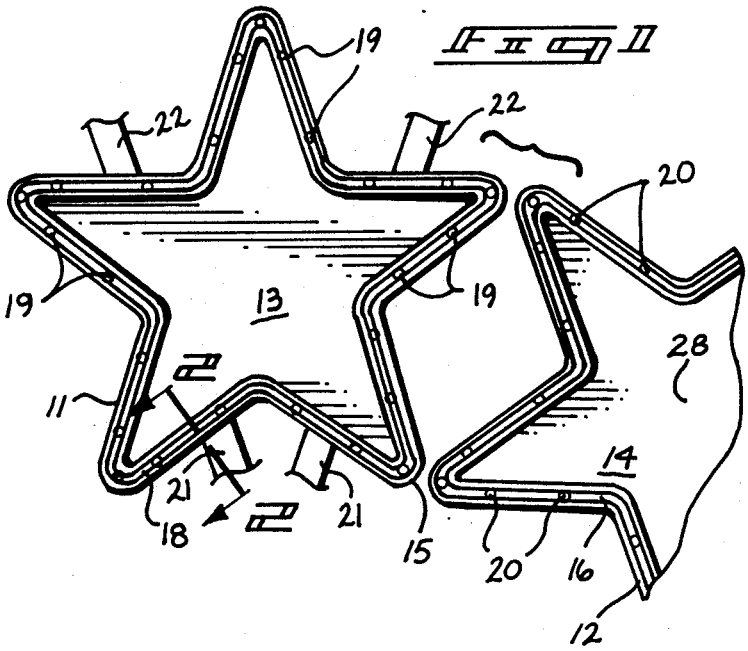
FIG. 1 is an orthographic plan view of the interior of each ice mold half.
Figure 2:
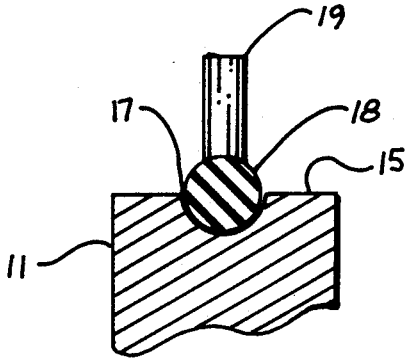
FIG. 2 is an orthographic view taken along the lines 2—2 of FIG. 1 in the direction indicated by the arrows.
Figure 3:
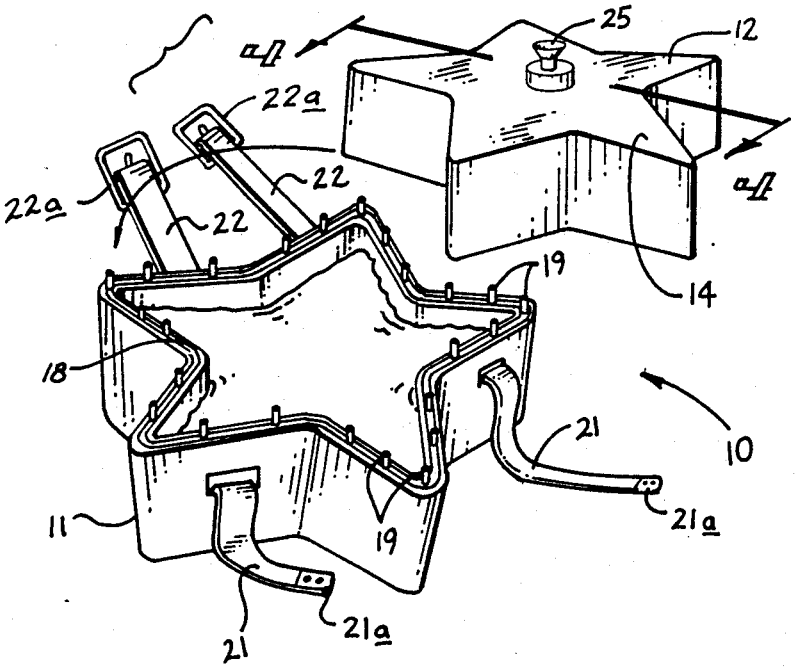
FIG. 3 is an isometric illustration of the instant invention during a filling procedure.

With reference now to the drawings, and in particular to FIGS. 1 to 7 thereof, a new and improved ice mold apparatus embodying the principles and concepts of the present invention and generally designated by the reference numeral 10 will be described.

More specifically, the ice mold apparatus 10 essentially comprises a bottom mold 11 and a complementary top mold 12. The respective bottom and top molds 11 and 12 are formed with predetermined cavities defining a bottom cavity 13 and a top cavity 14 with complementary interface surfaces comprising a bottom planar interface surface 15 and a top planar interface surface 16 selectively engageable and securable together to form a continuous internal cavity of the bottom and top cavities 13 and 14.

The bottom interface surface 15 includes a concave continuous channel 17 with a continuous elastomeric seal 18 of essentially circular cross-sectional configuration including a series of pins positioned through the seal 18 from the channel 17 and extending orthogonally upwardly of the bottom interface surface 15 for reception within complementary blind bores 20 formed within the top interface surface 16 to effect precise and secure registration of the top mold 12 upon positioning over the bottom mole 11.

A plurality of resilient first belts 21 are securable to a like plurality of resilient second belts 22 wherein the first belts 21 are formed with rigid securement ends 21a for interlocking with rigid buckles 22a of the second belts 22. Upon positioning of the top mold 12 in an overlying registration position with the bottom mold 11, the first and second belt pairs are secured together wherein the resilient nature of the belts 21 and 22 enables expansion of the molds 11 and 12 relative to one another upon expansion of fluid contained therewithin to avoid damage to the molds which may occur in usage of non-resilient belts.

Figure 4:
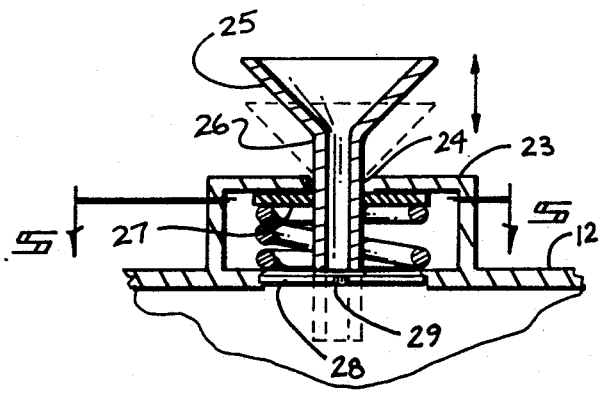
FIG. 4 is an orthographic view taken along the lines 4—4 of FIG. 3 in the direction indicated by the arrows.
Figure 5:
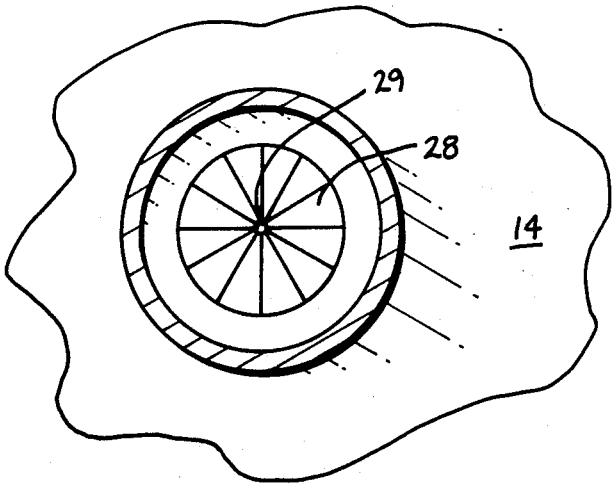
FIG. 5 is an orthographic view taken along the lines 5—5 of FIG. 4 in the direction indicated by the arrows.

A cylindrical housing 23 is formed orthogonally and upwardly of the top surface of the top mold 12 and formed with an axially positioned through-extending opening 24. A funnel 25 is captured slidingly within the opening 24 between the spout 26 of the funnel and the expanded upper end by a circular flange 27 extending orthogonally relative to the axis of the funnel 25. The diameter of the flange is greater than that of the diameter of the opening 24 to ensure capture of the funnel within the housing 23. The circular flange 27 is positioned below the upper conical portion of the funnel a distance at least equal to the thickness of a resilient iris diaphragm 28 formed with a central collapsing opening axially therethrough and aligned with the axis of the funnel 25. To complete filling of the ice mold apparatus 10 when the bottom and top molds 11 and 12 are secured together, the funnel 25 is merely directed downwardly through the central opening of the iris diaphragm 28 to expand the opening and enable the funnel spout 26 to project therethrough. Upon completion of filling of the ice mold apparatus 10, the funnel is withdrawn into position as illustrated in FIG. 4 overlying the diaphragm 28 wherein the central opening collapses upon itself and essentially seals the contents of the ice mold apparatus 10.

Figure 6:
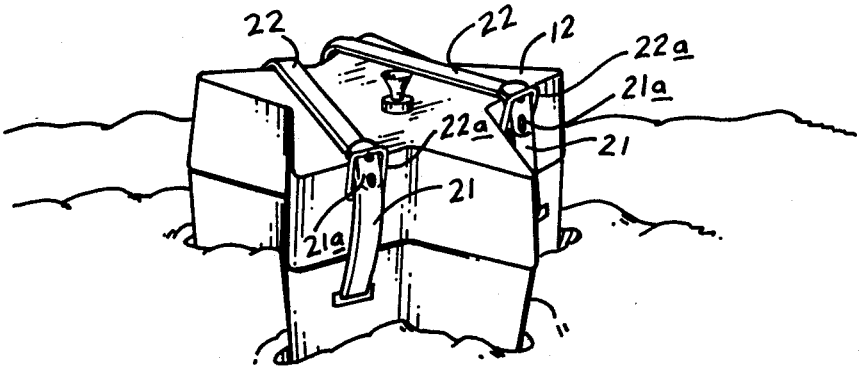
FIG. 6 is an isometric illustration of the ice mold apparatus in a liquid freezing environment.
Figure 7:
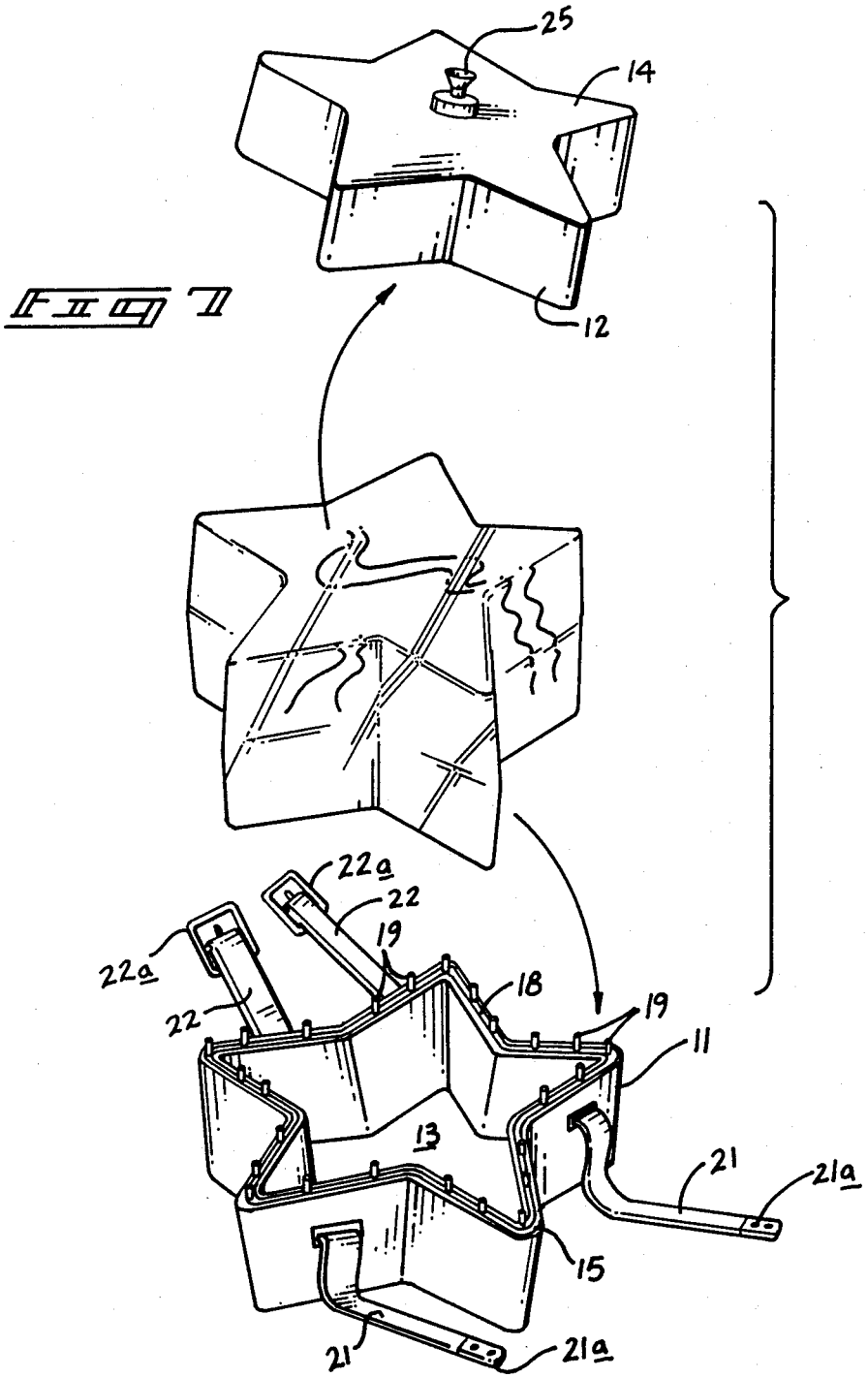
FIG. 7 is an isometric illustration setting forth separation of the ice molds to gain access to the frozen contents therein.

Further in use of the apparatus of the instant invention upon filling of the interior enclosed cavity of the mold 10 when the top and bottom mold are secured together, various dyes and colorations may be imparted into the mold through the funnel 25 to impart a predetermined coloration to a finished frozen product that is available upon removal of the molds, as illustrated in FIG. 7, subsequent to a freezing operation, as illustrated in FIG. 6.

As to the manner of usage and operation of the instant invention, the same should be apparent from the above description and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. An ice mold apparatus comprising, a bottom cup-shaped mold defining a bottom cavity, and a complementary top shaped mold defining a complementary top cavity to said bottom cavity, and said bottom cup-shaped mold including a continuous bottom planar surface including a continuous vertical bottom wall directed orthogonally upwardly thereof and including a horizontal top edge surface of said vertical bottom wall, and a continuous top planar surface of said top mold including a bottom edge surface of a continuous vertical top wall directed and formed vertically downwardly to said top mold wherein said bottom and top edge surfaces are of complementary configuration relative to each other to define a continuous interface and an enclosed cavity when said top and bottom molds are secured together, and sealing means integrally formed on said bottom edge surface to form a fluid containing seal at the interface, and alignment means extending upwardly of said top edge surface for reception and registration with said top edge surface to maintain said top mold in alignment with said bottom mold, and a plurality of flexible securement members secured to said bottom wall of said bottom mold to overlie said top mold to secure said top mold with said bottom mold, and said top planar surface including a flexible sealing member and a filling means slidably positionable from a first position overlying said sealing member to a second position extending through said sealing member to enable filling of said enclosed cavity, and including a continuous concave channel formed in said bottom planar surface containing said sealing means wherein said sealing means comprises a continuous elastomeric seal, and wherein said alignment means include a plurality of pins extending orthogonally relative to said bottom surface through said sealing means from said concave channel and positionable within blind bores formed in said top terminal surface wherein said bottom bores are of a complementary shape to said pins to securely receive said pins therewithin, and wherein said filling means includes a cylindrical housing extending upwardly from an upper surface of said top planar surface defining an axially through-extending bore therethrough wherein said filling means defines a funnel slidingly received through said bore, and wherein said funnel includes a spout and a conical receiving upper end mounted on said spout and in fluid communication therewith wherein said conical receiving upper end defines an abutment with an upper surface of said cylindrical housing when said spout is in said second position, and wherein said sealing member defines a diaphragm formed with central opening means for expansion to accept said spout when said funnel is in the second position.

* * * * *